US006766906B2

(12) United States Patent
Charng

(10) Patent No.: US 6,766,906 B2
(45) Date of Patent: Jul. 27, 2004

(54) WINDSHIELD WIPER PACKAGING CASE

(75) Inventor: Sheng Kao Charng, Taipei (TW)

(73) Assignee: Clearco Product Limited, Wu Ku Hsiang (TW)

( * ) Notice: Subject to any disclaimer, the term of this patent is extended or adjusted under 35 U.S.C. 154(b) by 175 days.

(21) Appl. No.: 10/206,223

(22) Filed: Jul. 29, 2002

(65) Prior Publication Data

US 2003/0062284 A1 Apr. 3, 2003

(30) Foreign Application Priority Data

Oct. 2, 2001 (TW) ..... 90216729 U

(51) Int. Cl.[7] ..... B65D 75/36; B65D 73/00

(52) U.S. Cl. ..... 206/470; 206/461; 206/469; 206/806

(58) Field of Search ..... 206/470, 461, 206/462, 463, 464, 467, 469, 471, 806

(56) References Cited

U.S. PATENT DOCUMENTS 4,854,450 A * 8/1989 Fisher ..... 206/469
5,027,947 A * 7/1991 Reighart ..... 206/335
5,105,942 A * 4/1992 van Veen et al. ..... 206/364
5,156,267 A * 10/1992 Yates et al. ..... 206/364
5,379,896 A * 1/1995 Snow et al. ..... 206/470
5,899,334 A * 5/1999 Domerchie et al. ..... 206/470
D434,226 S * 11/2000 Strohmeier ..... D3/294

FOREIGN PATENT DOCUMENTS

GB 2190066 A * 11/1987 ..... B65D/75/36

* cited by examiner

*Primary Examiner*—Jila M. Mohandesi
(74) *Attorney, Agent, or Firm*—Leong C. Lei

(57) ABSTRACT

An improved windshield wiper packaging case includes a joined top and bottom case. The top case contains an arched compartment with two symmetric clips which bind the packing sheet; adjacent to the arched compartment is a triangular-shaped elongated compartment that holds the windshield wiper. On the upper side, next to the arched compartment is a rectangular compartment which holds the manufacturing label. On the bottom case, there are protruded line-shaped clasps along the edges of said bottom case; within the clasps, two precut U-shaped clips are positioned to hold the instruction sheet. All additional clips, clasps, shaped compartments are for the purpose of holding every component in place and preventing disarray and damage. This design also makes assembling easier and more efficient and the assembled packaging appears structured and pleasing to behold by the consumer, moreover, the consumers can easily inspect the contents from different angles through this improved packaging design.

3 Claims, 7 Drawing Sheets

WINDSHIELD WIPER PACKAGING CASE

BACKGROUND OF THE INVENTION (a) Field of the Invention

The present invention relates to a windshield wiper packaging case, and in particular, an easily assembled, appealing, functional, and value added packaging case which enables consumers to inspect its contents easily from different angles through its transparent packaging.

(b) Description of the Prior Art

FIG. 1 shows a conventional windshield wiper packaging case having an elongated cardboard base 11 with instructions printed on the back, on which is adhered an airtight plastic cover 12 to keep a windshield wiper 2 and spare parts 3 therein. FIG. 2 shows another conventional windshield wiper packaging case, with an airtight plastic cover 21 affixed to a cardboard base 22 and storing a windshield wiper 2 and spare parts 3 therein, and also having instructions printed on the back. Neither conventional packaging case accommodates the windshield wiper and parts properly, and as a result the contents may appear in disarray, the spare parts can slide around, and even be scratched during shipping, leading the consumer to become dissatisfied with the appearance of the product, and hence decreasing its competitive ability.

SUMMARY OF THE INVENTION

Accordingly, it is an object of the present invention to provide an improved windshield wiper packaging case to hold the windshield wiper, manufacturing label, spare parts and instruction sheet in place, making its appearance structured and organized and preventing shipping damage. Moreover, this invention will enable consumers to inspect the contents from different angles through this improved packaging design, hence adding value to the product.

The structure of the present improved packaging case comprises a jointed top and bottom case, and within the said top and bottom case there is constructed a plurality of coupled clasps to bind the top and bottom case.

Another aspect of the present invention is where said top case has included an arched compartment with two inward symmetric clips within an inner side of said compartment which binds the packing sheet and houses the spare parts. Adjacent to the said arched compartment is constructed a triangular-shaped, elongated compartment to hold the windshield wiper. Due to this triangular design the structure strength is reinforced and it is easier for the consumer to inspect the windshield wiper.

Yet another aspect of the present invention is where said top case contains a rectangular compartment holding the manufacturing label disclosing the trademark and size of the product, which enables the consumer to inspect this information more easily.

Still another aspect of the present invention is where the bottom case has protruded line-clasps positioned along its edges, and pre-cut U-shape clips constructed within the line-clasps, which hold the instruction sheet.

DETAILED DESCRIPTION OF THE PREFERRED EMBODIMENT

A preferred embodiment of the present invention is hereinafter described with reference to the attached drawings.

Figure 1:
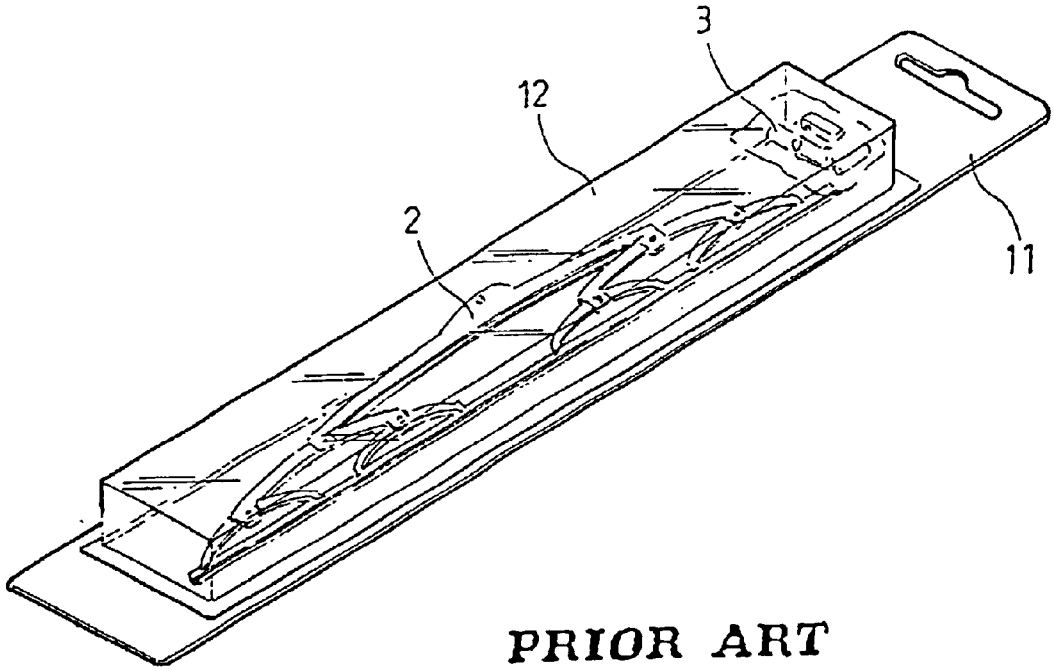
PRIOR ART FIG. 1
FIG. 1 is a perspective view of a conventional windshield wiper packaging case.
Figure 2:
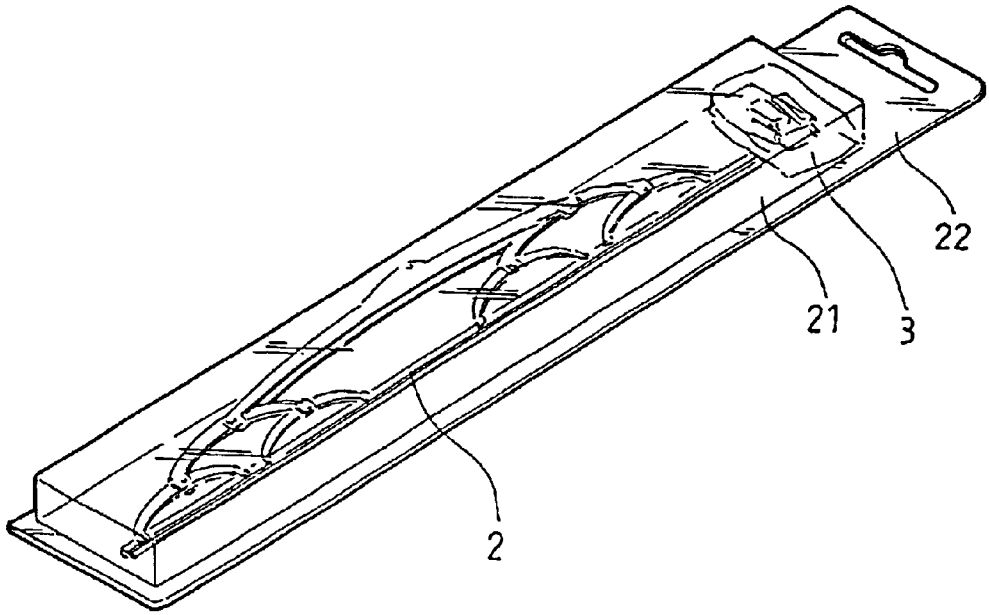
PRIOR ART FIG. 2
FIG. 2 is a perspective view of another conventional windshield wiper packaging case.
Figure 3:
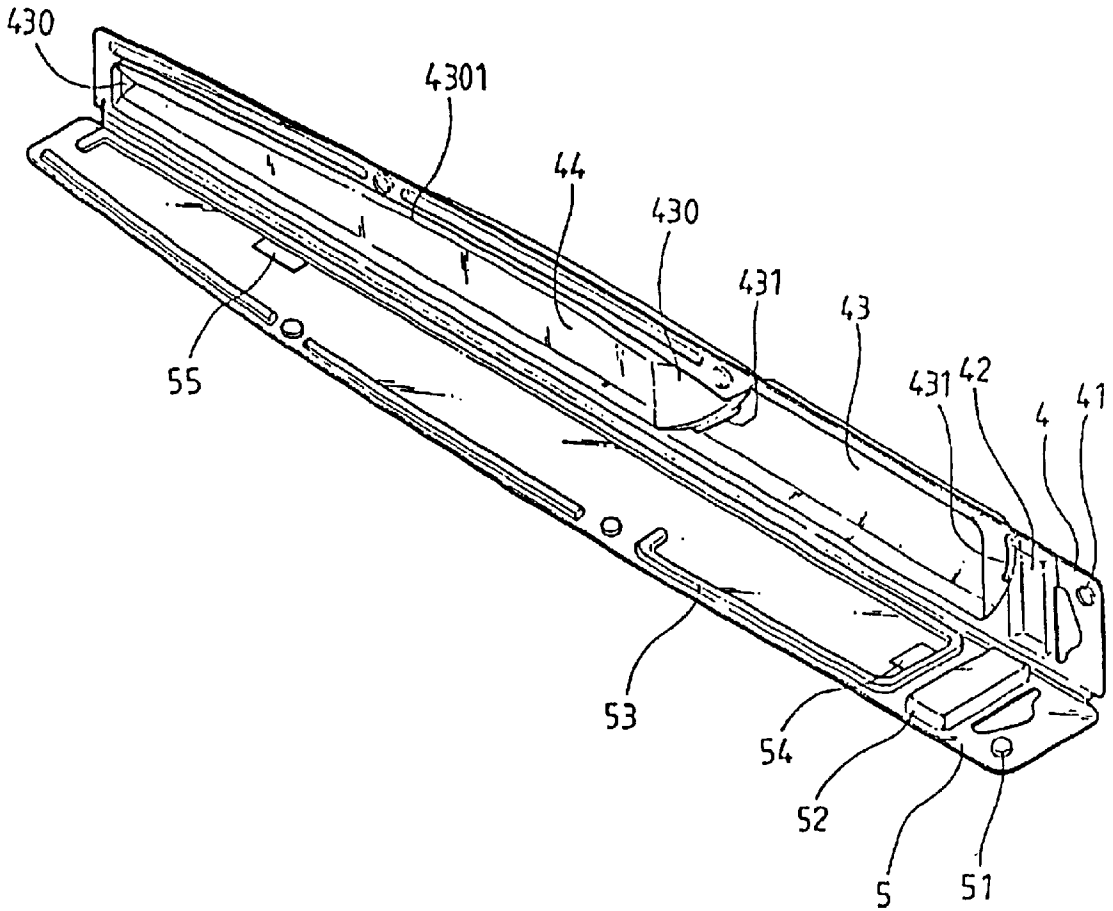
FIG. 3 is a perspective view of a preferred embodiment of a windshield wiper packaging case according to the present invention.

Referring to FIG. 3, the present invention comprises a laterally joined top case 4 and bottom case 5 which can be easily opened and closed, coupled clasps 41 and 51 on the upper side of top case 4 and bottom case 5 respectively, a rectangular compartment 42 located on the upper side of top case 4 constructed to hold the manufacture label, and an arched compartment 43 located under rectangular compartment 42, wherein the arched compartment 43 has symmetric clips 431 to hold spare parts 3 and packing sheet 7. Adjacent to the the arched compartment 43 is a triangular-shaped, elongated compartment 44 which is made up of two sloping surfaces 430, and a ridge line 4301 joins the two sloping surfaces 430, thus reinforcing the elongated compartment 44 through the triangular design.

When the improved packaging case is in an assembled state, the windshield wiper, packing sheet, spare parts, manufacture label and instruction sheet are all properly secured, organized and prevented from sliding. As the top and bottom cases are transparent, the consumer can easily inspect the products, thus adding value to the product through this presentation.

Figure 4:
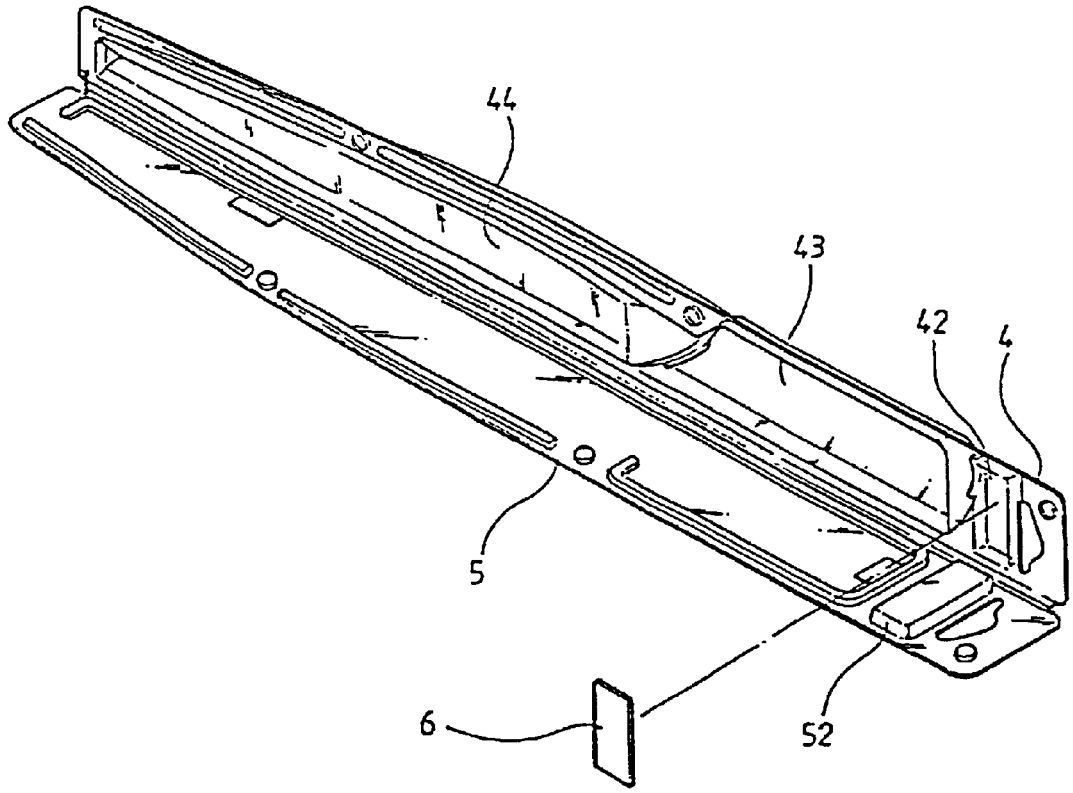
FIG. 4 is an exploded view of an illustration of the positioning of the manufacturing label according to the present invention.

Referring to FIG. 4, while assembling the present invention, when clasping the top case 4 and bottom case 5 together, the protruded platform 52 on the bottom case 5 will press against the coupled rectangular compartment 42, and firmly hold the manufacturing label 6 inside the compartment.

Figure 5:
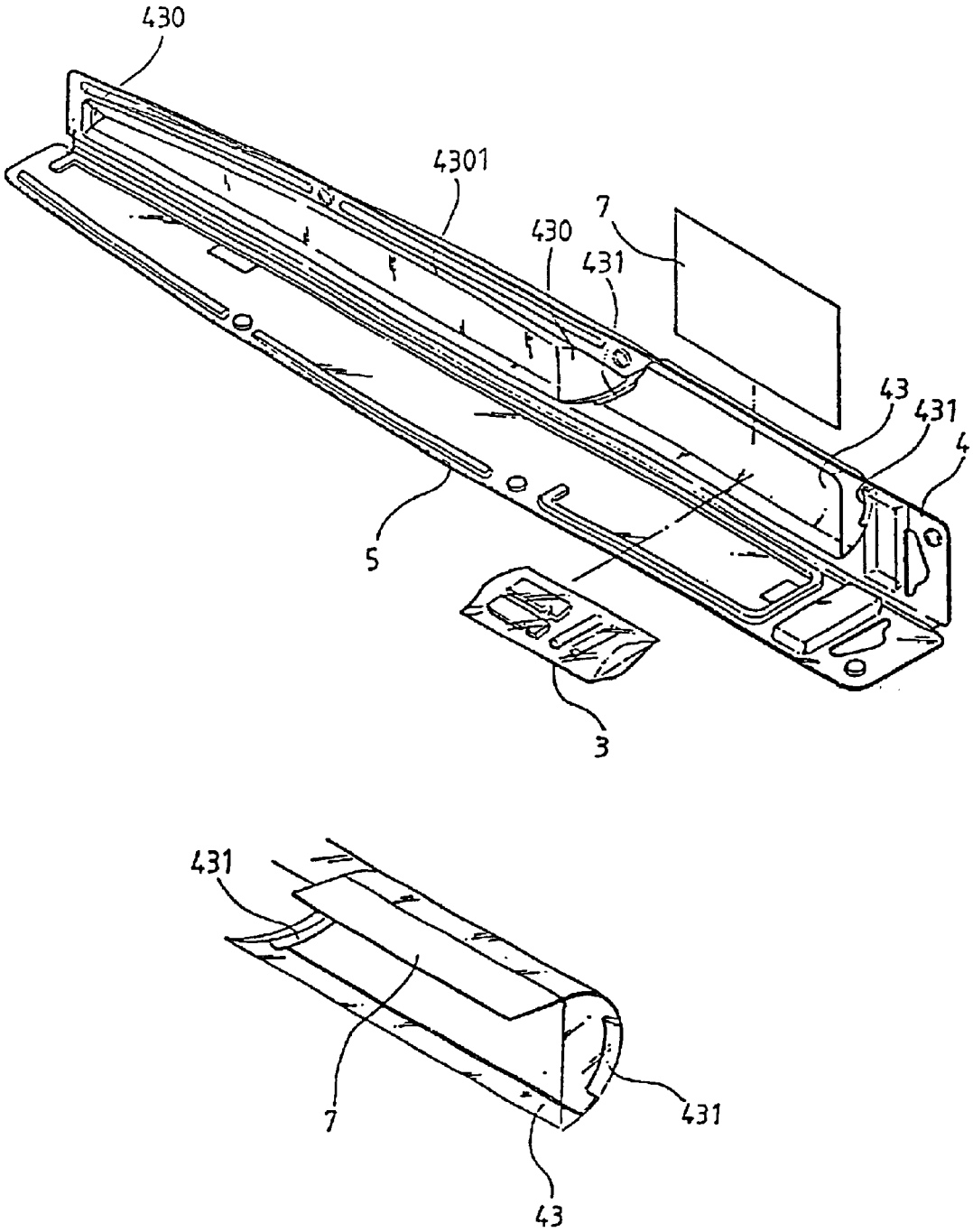
FIG. 5 is an exploded view of an illustration of the arrangement of the spare parts and packing sheet according to the present invention.

Referring to FIG. 5, while assembling the present invention, the packing sheet 7 will be slid into the inner-upper side of the arched compartment 43 of the top case 4, and secured by clips 431. The arched compartment 43 will then accommodate the spare parts 3.

Figure 6:
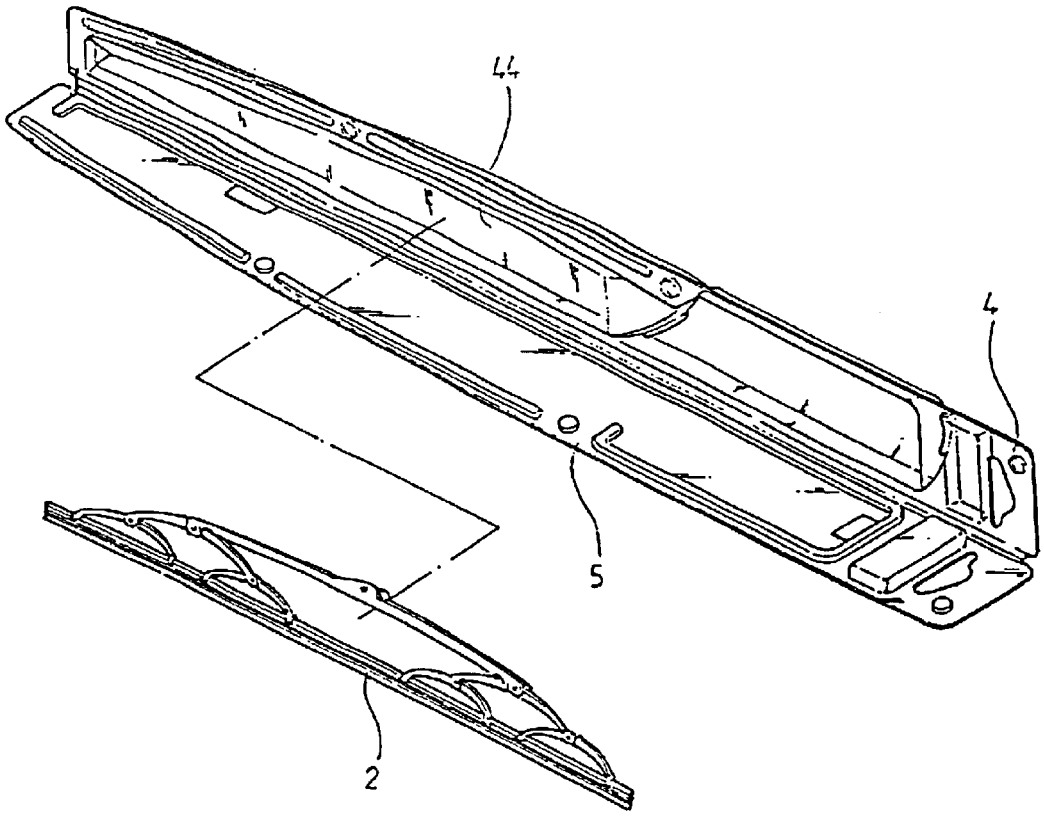
FIG. 6 is an exploded view of an illustration of arrangement windshield wiper according to the present invention.
Figure 7:
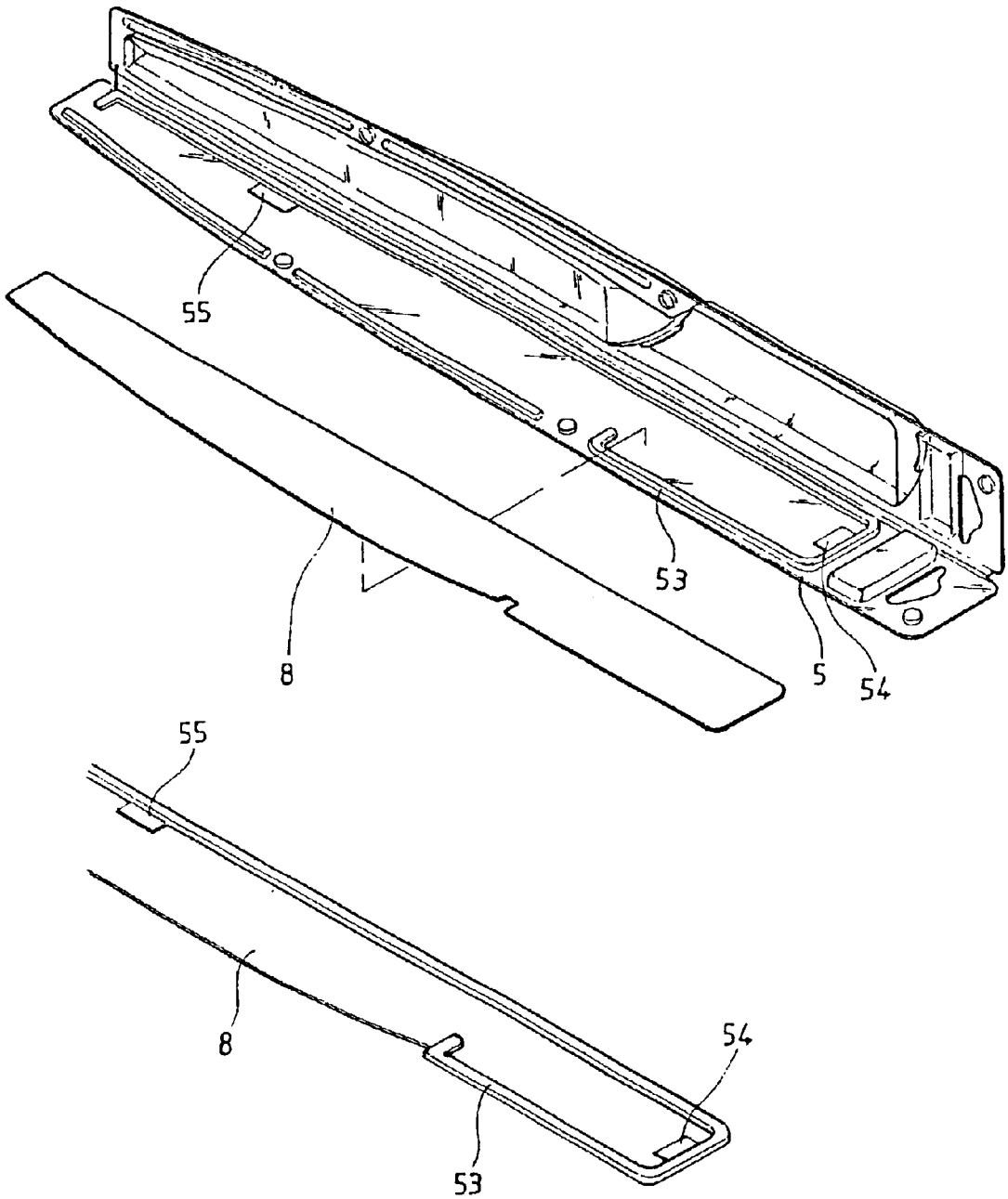
FIG. 7 is an exploded view of an illustration of the arrangement of the instruction sheet according to the present invention.

Referring to FIG. 6, while assembling the present invention, the elongated compartment 44 will house windshield wiper 2. The instruction sheet 8 will be located in the bottom case 5 and secured by clips 54 and 55 (as shown in FIG. 7).

Figure 8:
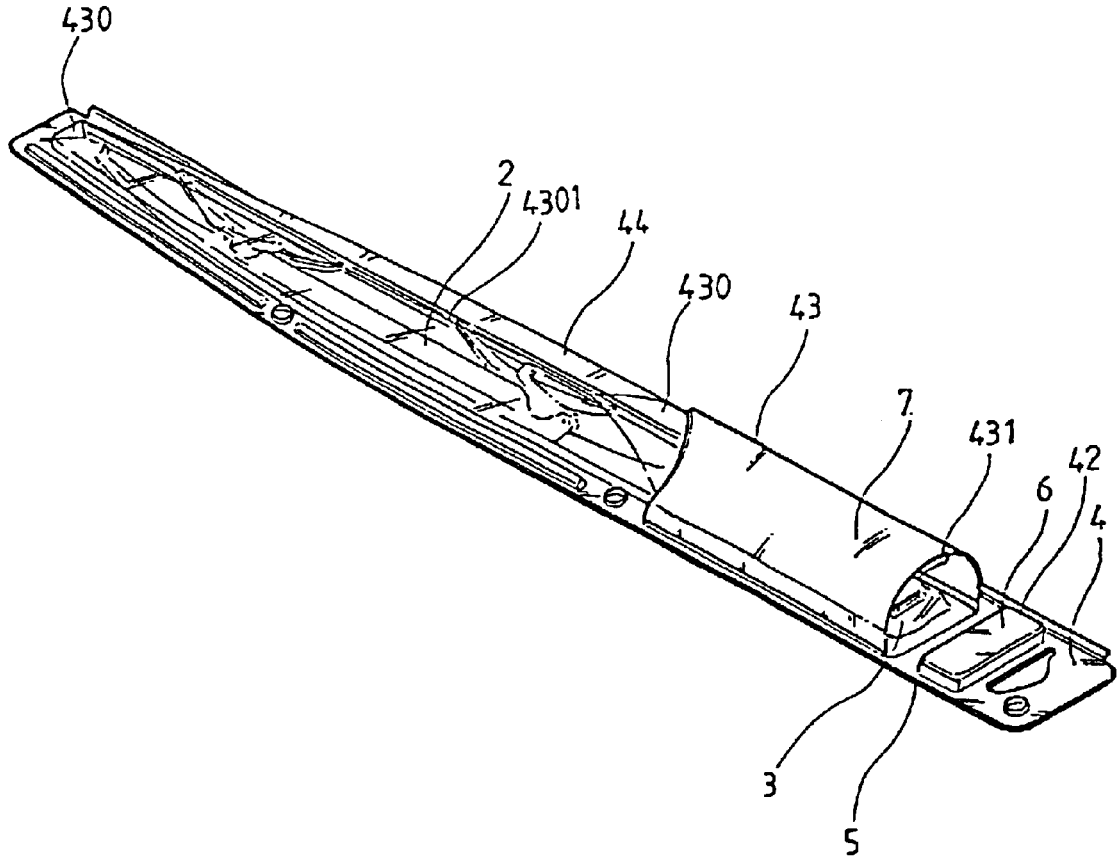
FIG. 8 is a perspective view of the assembled embodiment according to the present invention.

FIG. 8 shows the present invention in assembled state, with the manufacturing label 6, packing sheet 7, windshield wiper 2 and the instruction sheet all properly arranged, organized and secured in place. The assembled package according to the present invention appears functional and appealing and different from the conventional packaging methods, which have their contents in disarray. In addition, the improved design, and transparent triangular elongated compartment 44, allows the consumer to easily inspect the windshield wiper 2 and by the characteristic manufacturing label 6, the consumer can easily choose the suitable product size they require, hence increasing the consumer's satisfaction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An improved windshield wiper packaging case comprising:

a top case, wherein the upper section of said top case has constructed a rectangular compartment, in the lower section of said rectangular compartment is constructed an arched compartment; inside the inner edges of said arched compartment are located symmetric clips; adjacent to said arched compartment is constructed an elongated compartment made up of two sloping sides which are joined by a ridge line to form a triangular-shaped elongated compartment;

a bottom case, laterally joined together with the top case, whereon said bottom case is constructed a corresponding protruding platform to match with said top case, a rectangular compartment, which has line-shape clasps located along its edges, and within said clasps are precut U-shape clips;

whereby a windshield wiper, a packing sheet, a manufacture label, spare parts and a instruction sheet are housed into different compartments thereby producing a structured, organized product and making it easier for consumers to examine the product from different angles.

2. An improved windshield wiper packaging case according to claim 1, wherein the specific design used to joint said top case and bottom case has corresponding clasps located at appropriated positions on the top and bottom case for easy fastening.

3. An improved windshield wiper packaging case according to claim 1, wherein said top case and bottom case are made up of transparent plastic for easy inspection of the contents.

* * * * *